US006884135B2

(12) United States Patent
Hu

(10) Patent No.: US 6,884,135 B2
(45) Date of Patent: Apr. 26, 2005

(54) DIVING FINS

(76) Inventor: Chia-Te Hu, 4F, No. 16, Lane 216, How-Gaang St., Taipei (TW)

( * ) Notice: Subject to any disclaimer, the term of this patent is extended or adjusted under 35 U.S.C. 154(b) by 27 days.

(21) Appl. No.: 10/631,777

(22) Filed: Aug. 1, 2003

(65) Prior Publication Data

US 2005/0026519 A1 Feb. 3, 2005

(51) Int. Cl.[7] ..... A63B 31/08
(52) U.S. Cl. ..... 441/64
(58) Field of Search ..... 441/55, 60–64; D21/803, 806

(56) References Cited

U.S. PATENT DOCUMENTS 3,032,787 A * 5/1962 Mazzella ..... 441/64
3,055,025 A * 9/1962 Ferraro et al. ..... 441/64

* cited by examiner

*Primary Examiner*—S. Joseph Morano
*Assistant Examiner*—Ajay Vasudeva
(74) *Attorney, Agent, or Firm*—Rosenberg, Klein & Lee

(57) ABSTRACT

An improved diving fin includes a first web surface and a second web surface. The first web surface extends between a pair of first longitudinal flukes, and the second web surface extends between a pair of tapered second longitudinal flukes. The first longitudinal flukes and the tapered second longitudinal flukes are connected at their respective rear ends. A plurality of transverse adjusting flukes are separately coupled to each of the first longitudinal flukes and the tapered second longitudinal flukes at the rear ends. Any number of the transversal adjusting flukes can be selectively severed so that a diver can change the swinging length of the second web surface according to personal needs.

2 Claims, 9 Drawing Sheets

DIVING FINS

BACKGROUND OF THE INVENTION

1) Field of the Invention

The invention herein relates to improved diving fins.

2) Description of the Prior Art

The typical structure and operational details of a conventional pair of diving fins are shown in FIG. 1, wherein the longitudinal fin surface 10 of the said fins 1 is comprised of a single web section 102 disposed between longitudinal fluke 101 along two sides. When the diver executes the posterior extension and anterior bending of both legs (conventionally consisting of an alternating upward and downward fluttering action), the two said longitudinal flukes 101 directly support the web section 102 during the aquatic kicking sequence and enables the objective of diver mobility. Undeniably, the single web section 102 of the conventional fins that enables aquatic kicking propulsion possesses practical value and provides functional performance and, furthermore, is currently in widespread use among a majority of divers. However, the inventor of the invention herein discovered several shortcomings that were observed over a period of long-term utilization, each of which can be feasibly improved.

1. To reinforce the web section 102 during aquatic kicking, specifically against contortion due to water drag that results in an incapability to generate thrust, the two longitudinal flukes 101 supporting the web section 102 must be of a relatively hard composition such that when the diver articulates both legs into posterior extension for aquatic kicking and the greater active extent of the fin surface 10 is an inclined disposition, the fin surface 10 and the two longitudinal flukes 101 with which it is formed as a single structural entity and, furthermore, the rigidly configured longitudinal web section 102 must also be in an inclined disposition such that water is kicked at an oblique angle. However, as is well-known by all, the angle at which the said web section 102 generates maximum aquatic kicking efficiency is one that is perpendicular to the traveling direction of the diver. Given the oblique angle of aquatic kicking attack of the said web section 102, the reactive force (i.e., thrust) generated is not proportional to the aquatic kicking power delivered by the diver and results in less than optimal aquatic kicking efficiency.

2. As per the said shortcoming, since the fin surface 10 is in an inclined disposition, the said web surface 102 is accordingly at an oblique angle during aquatic kicking and consequently cannot provide a reactive force (thrust) that is proportional to the aquatic kicking power applied, therefore, to maintain underwater traveling speed, the diver must increase the rate of aquatic kicking, which obviously results in the drawbacks of a greater dissipation of physical strength and an easier onset of fatigue.

3. Since the said planar longitudinal web section 102 and the relatively hard longitudinal fluke 101 are formed as a single structural entity that is rigidly configured, when the diver articulates both legs forward and upward preparatory to aquatic kicking by anterior bending, the forward and upward flexing of the planar web section 102 encounters relatively high fluid drag and, as such, the obvious shortcomings affecting diver articulation are the need use more strength and an inability to effectively increase speed.

4. Since the said two longitudinal flukes 101 are relatively hard constructs, they are capable of supporting the single, large surface area of the web section 102 during the articulation of both legs during aquatic kicking. However, the relatively hard composition of the said longitudinal fluke 101 obviously affects the degree, of pliability of the fin surface 10, which in turn influences the degree of agility and control, resulting in stiffness and lack of smoothness.

In view of the foregoing shortcomings, the inventor of this invention suggested improved diving fins structure as disclosed in the U.S. Pat. No. 6,520,816, in which a first channel $A_1$ is formed transversally across the approximate center portion of a longitudinal web section 102, and a longitudinal fluke 101 along the two sides each with one end proximate a boot section 11 and the other end coupled to a second channel $A_2$ and a third channel $A_3$ which are connected to the first channel $A_1$, so that the web section 102 can be isolated from a fixed first web surface 1021 and a flexile second web surface 1022.

The flexibility and swinging motion of the second web surface 1022 allows the second web surface 1022 to automatically deviate forward during flutter kick execution and then be coordinated into a nearly perpendicular state by the first web surface 1021 to achieve a larger surface area of force application. The force produced by the diver's flutter kicking not only maximizes a reactive force (i.e., thrust) of the aquatic kicking efficiency and increases diver speed, but also lower the kick rate of the diver directly, thereby conserving physical strength and delaying the onset of fatigue.

In other words, the foregoing diving fins structure according to the U.S. patent previously granted to the present inventor can overcome the shortcomings of the conventional diving fins, and divers can optimize the kicking efficiency while conserving physical strength.

Further to conserve physical strength and increasing kicking efficiency for divers of all ages when using the diving fins, the inventor of this invention conducted researches to improve the structure as disclosed in the U.S. Pat. No. 6,520,816, and finally invented this invention.

SUMMARY OF THE INVENTION

The primary objective of the invention herein is to provide improved diving fins, wherein a pair of second longitudinal flukes, each with its front section thinner than its rear section, are respectively disposed on two sides of a second web surface, such that when the diver articulates both legs for the alternate kicking motions, the second longitudinal flukes working together with the second web surface forms the water containing situation, not only providing a better flutter kicking efficiency, but the design of having a front section thinner than the back section of each second longitudinal fluke also makes the swinging of the second web surface as lively as a fish and attains the natural effect.

Another objective of the invention is to provide improved diving fins wherein a second longitudinal fluke on both sides of the second web surface and a front end coupled to a first longitudinal fluke on both sides of the longitudinal web section connects to a plurality of transversal adjusting flukes in form of partitions, and such adjusting flukes could be cut one by one in order to change the length of the swinging of the second web surface, so that a user may appropriately set the length of the swinging of the second web surface according to the physical strengths and ages of individuals. This invention allows the diver to enjoy efficient strength conservation and higher speed performance while articulating both legs in the process of aquatic kicking.

Still another objective of the invention is to provide improved diving fins, wherein the rear section of the first web surface has a conical transversal fluke with its front thicker than its rear, so that when a diver articulates both legs in the process of aquatic kicking or prepares for the kicking, the rear section of the first web surface guides the water to flow smoothly forward, (that is in the direction rearward of the diver) and thus giving a higher kicking efficiency.

DETAILED DESCRIPTION OF THE INVENTION

Figure 1:
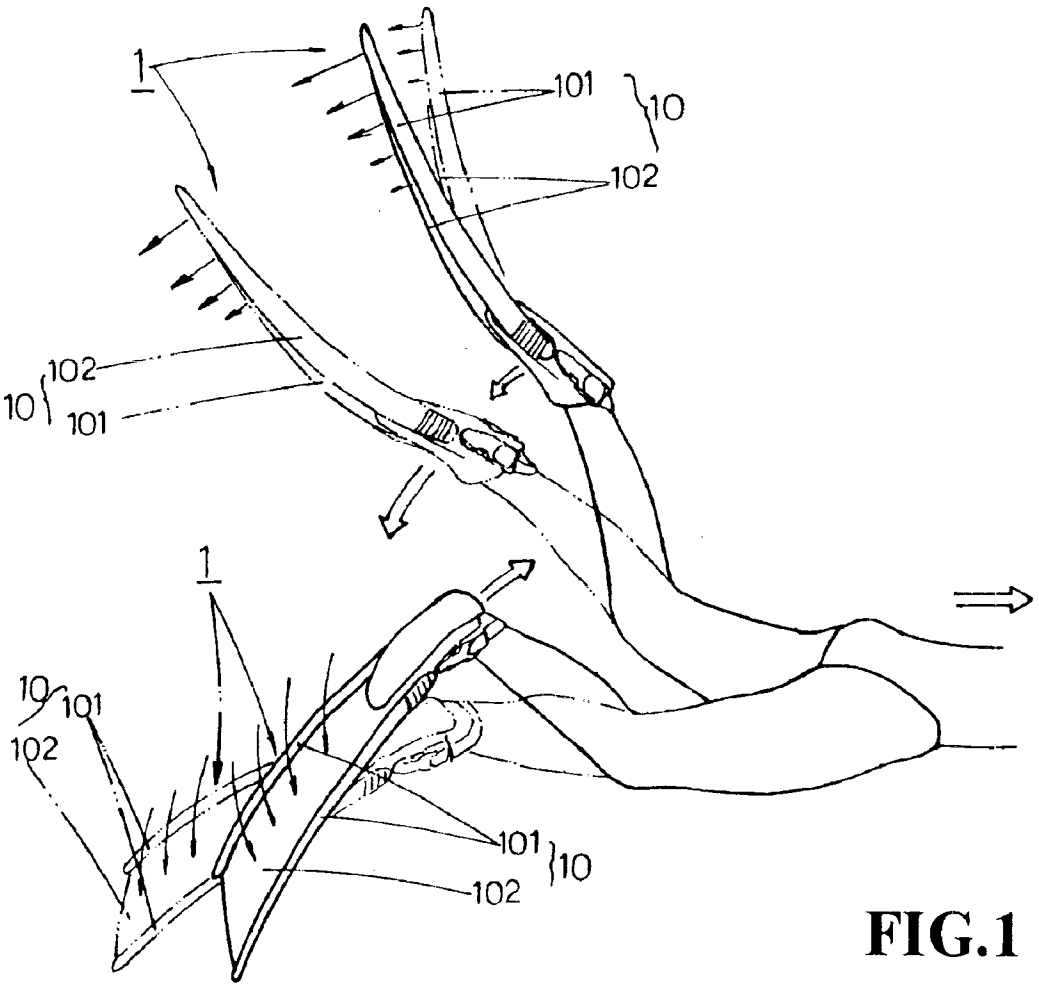
FIG.1 PRIOR ART
FIG. 1 is an illustrative diagram of the structure and operational details of conventional diving fins.
Figure 2:
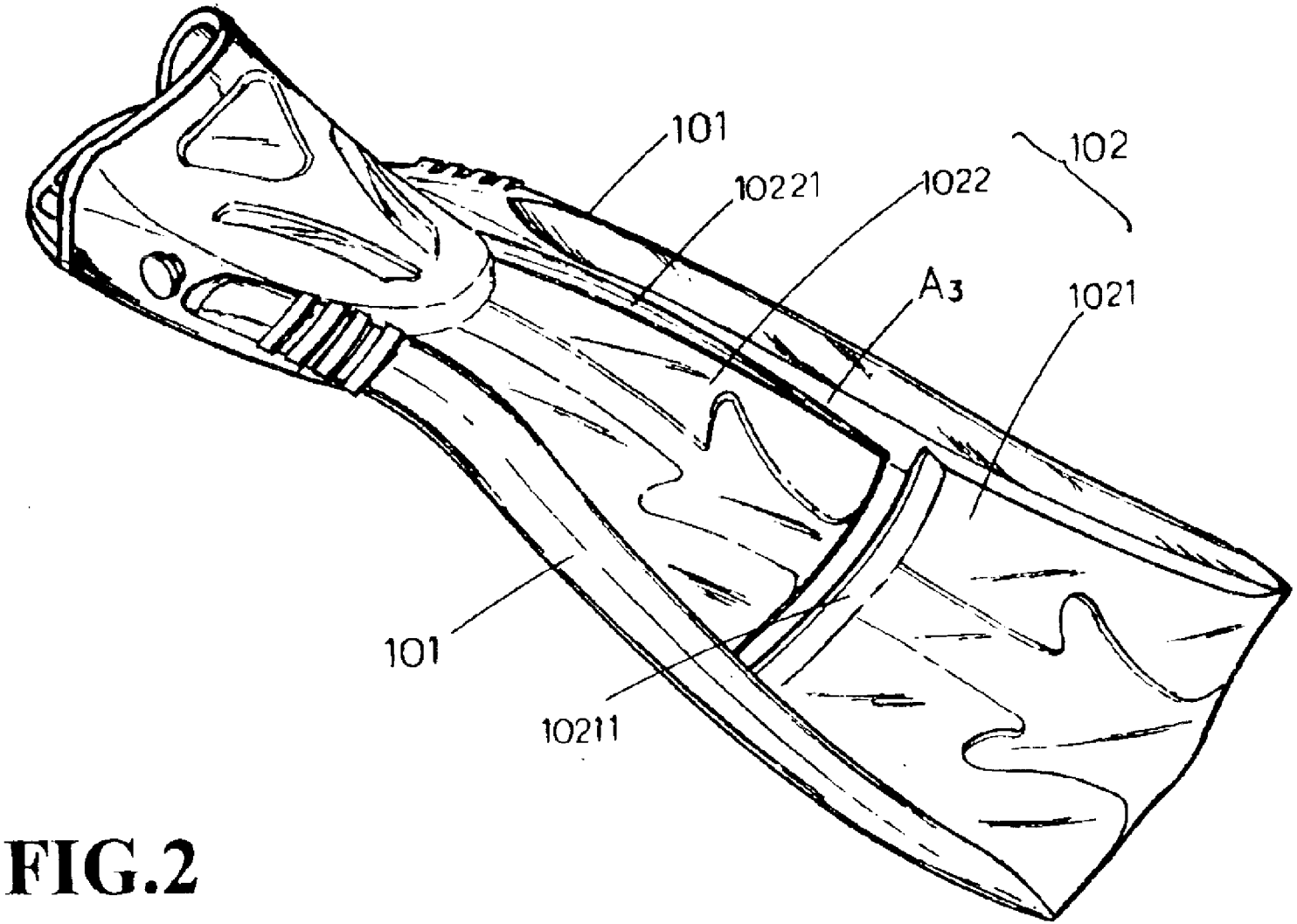
FIG. 2 is an illustrative diagram of the present invention.
Figure 3:
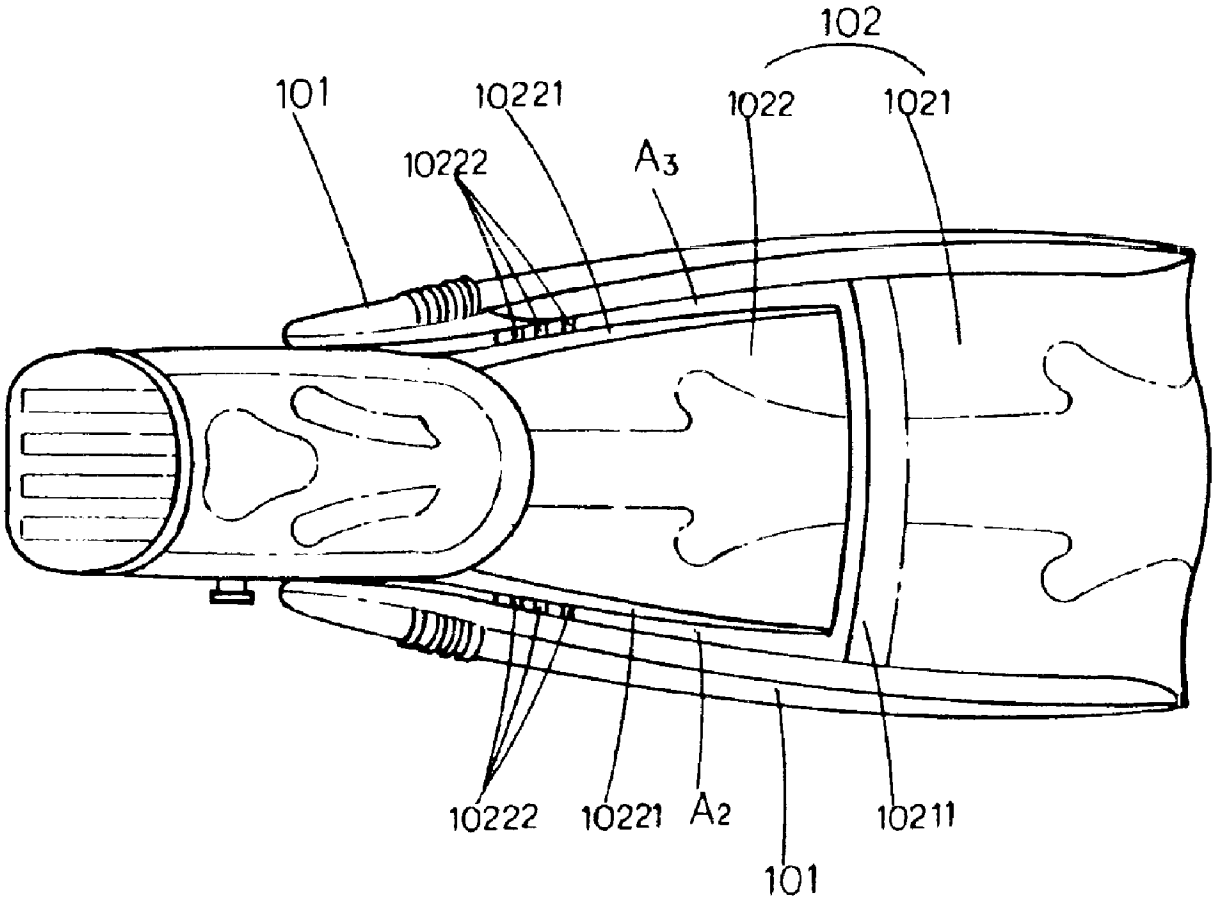
FIG. 3 is a top-view diagram of FIG. 2.
Figure 4:
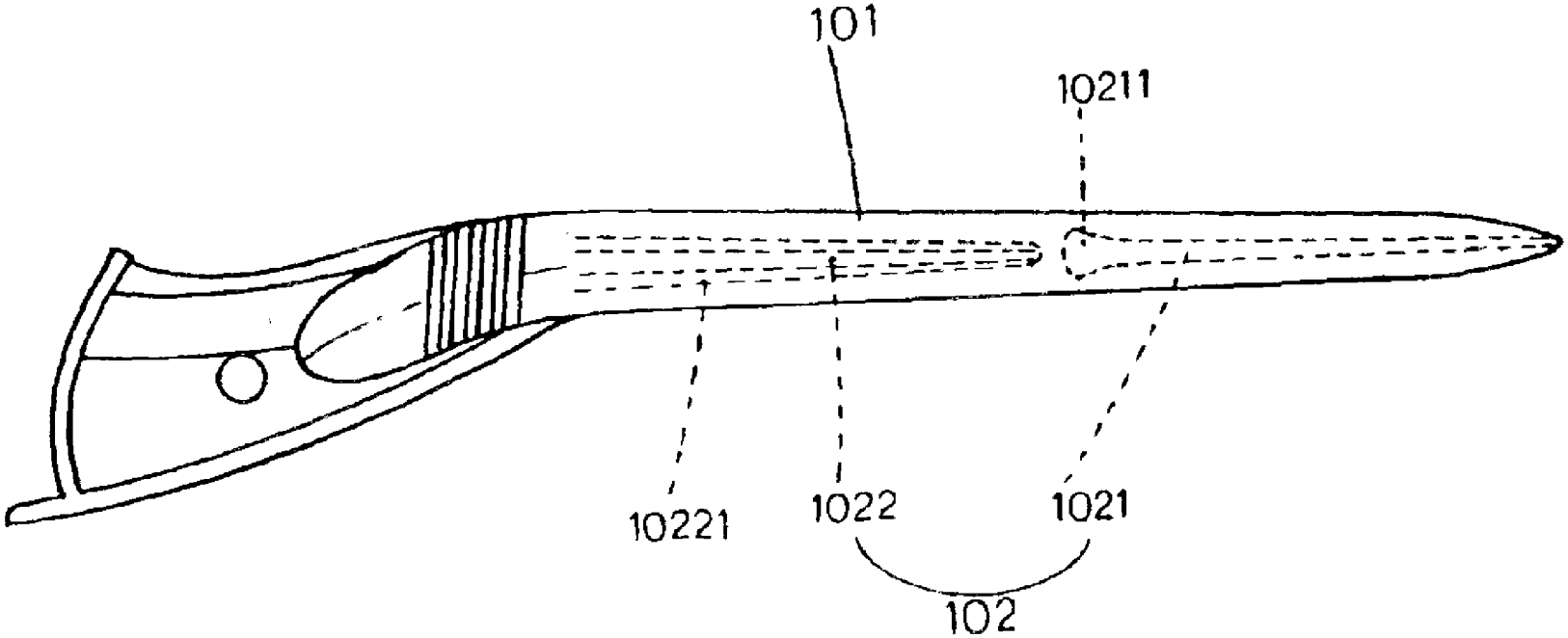
FIG. 4 is a side-view diagram of FIG. 2.
Figure 5:
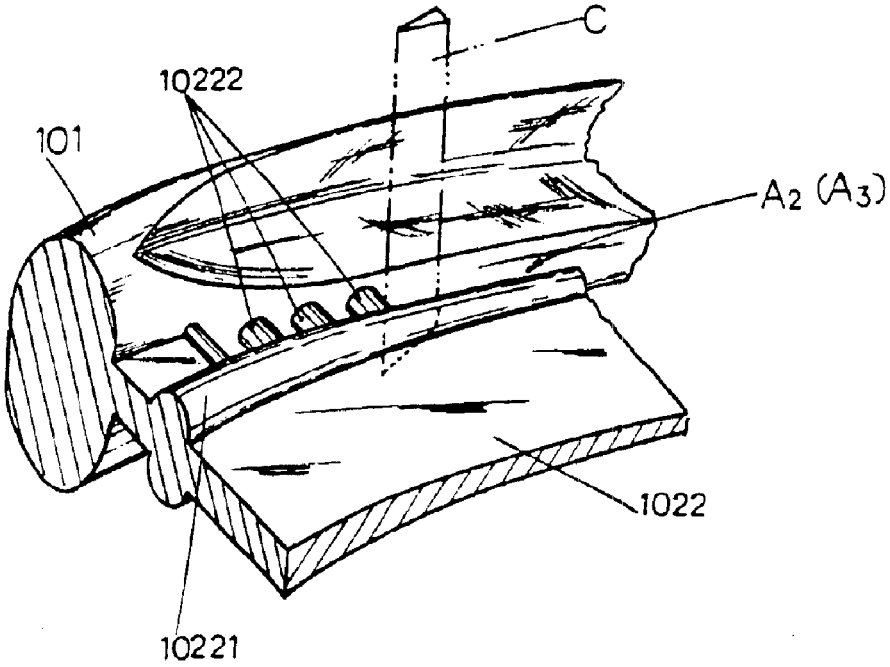
FIG. 5 is an illustrative diagram of the disposition of transversal adjusting flukes according to the present invention.
Figure 6:
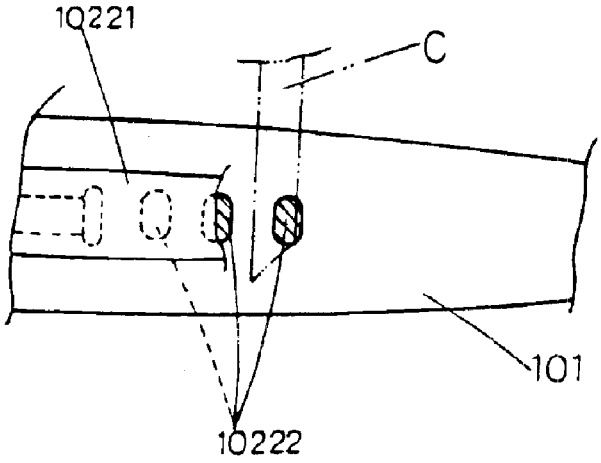
FIG. 6 is a side-view diagram of FIG. 5.
Figure 7:
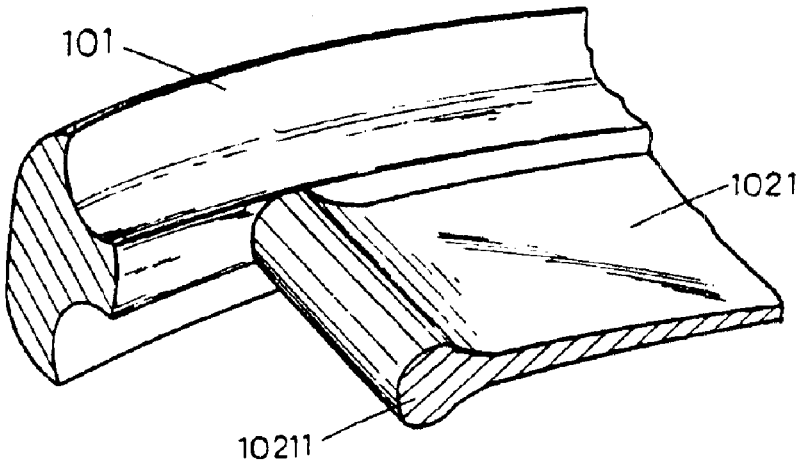
FIG. 7 is an illustrative diagram of the disposition of the transversal adjusting flukes according to the present invention.
Figure 8:
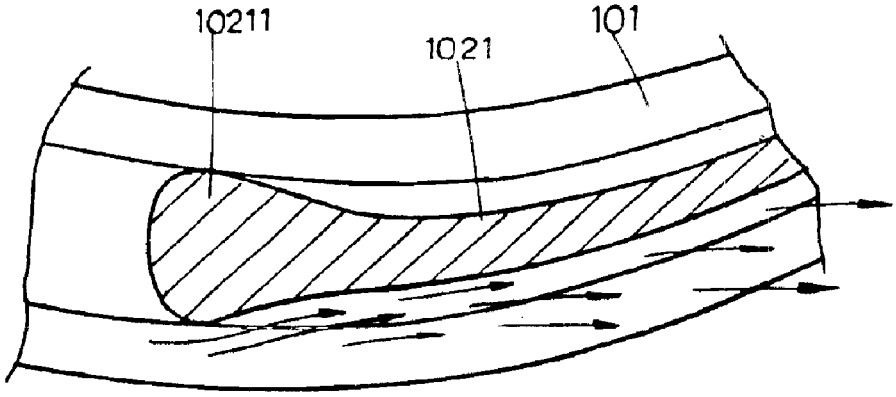
FIG. 8 is an illustrative diagram of the swinging status of the first web surface as shown in FIG. 7.

Referring to FIGS. 2, 3, and 4, it is obvious that the improved diving fins of the invention comprise a pair of tapered second longitudinal flukes 10221 respectively disposed on each longitudinal side of a second web surface 1022 (please refer to FIGS. 5 and 6); a rear end coupled to first longitudinal fluke 101 on both sides of the second longitudinal fluke 10221 and a longitudinal web section 102 being connected to a plurality of transversal adjusting flukes 10222 (please also refer to FIGS. 5 and 6) in the form of partitions; and a conical transversal fluke 10211 disposed at the rear section of the first web surface 1021 (please also refer to FIGS. 7 and 8) with its front section thinner than its rear section.

Figure 9:
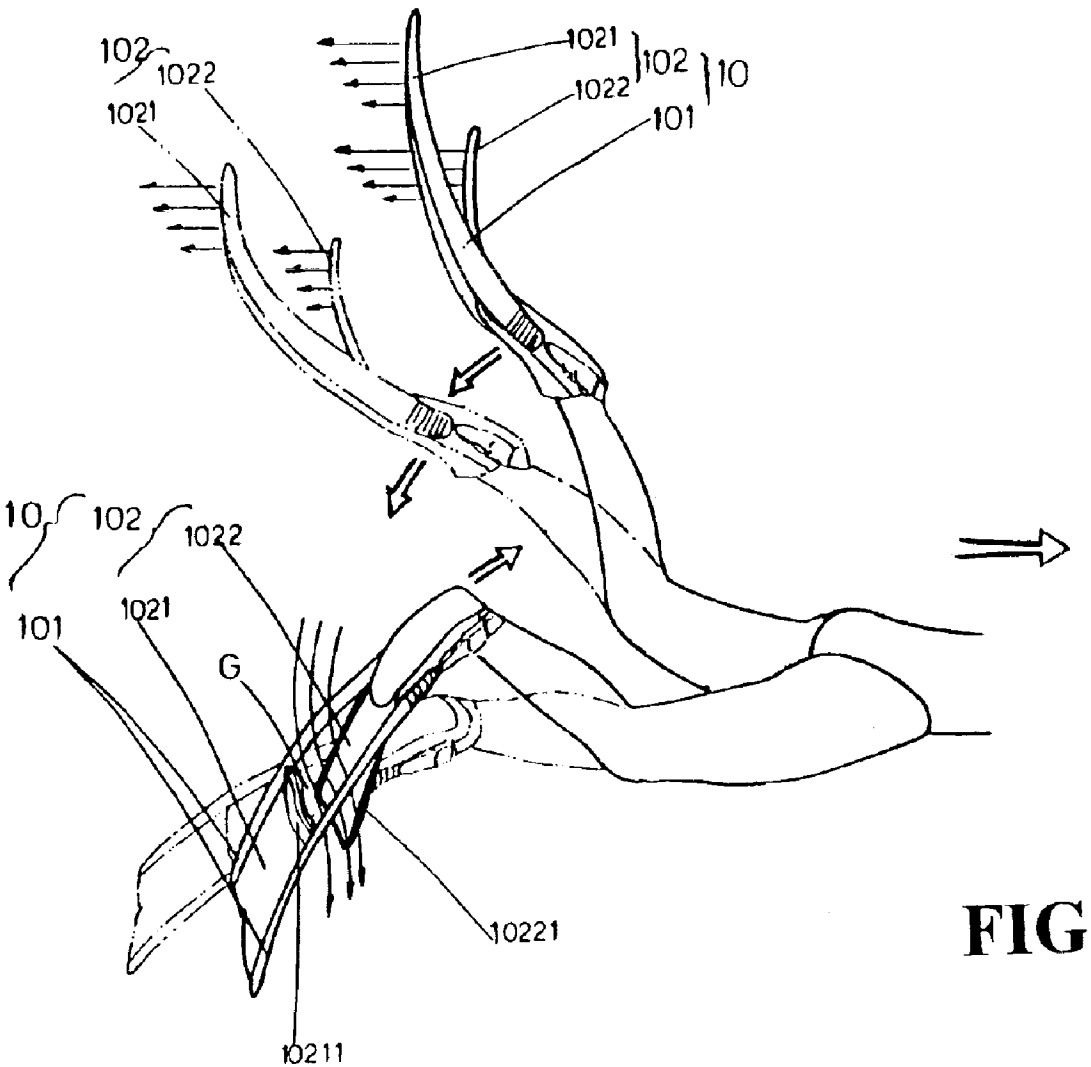
FIG. 9 is an illustrative diagram of the present invention when it is in use.
Figure 10:
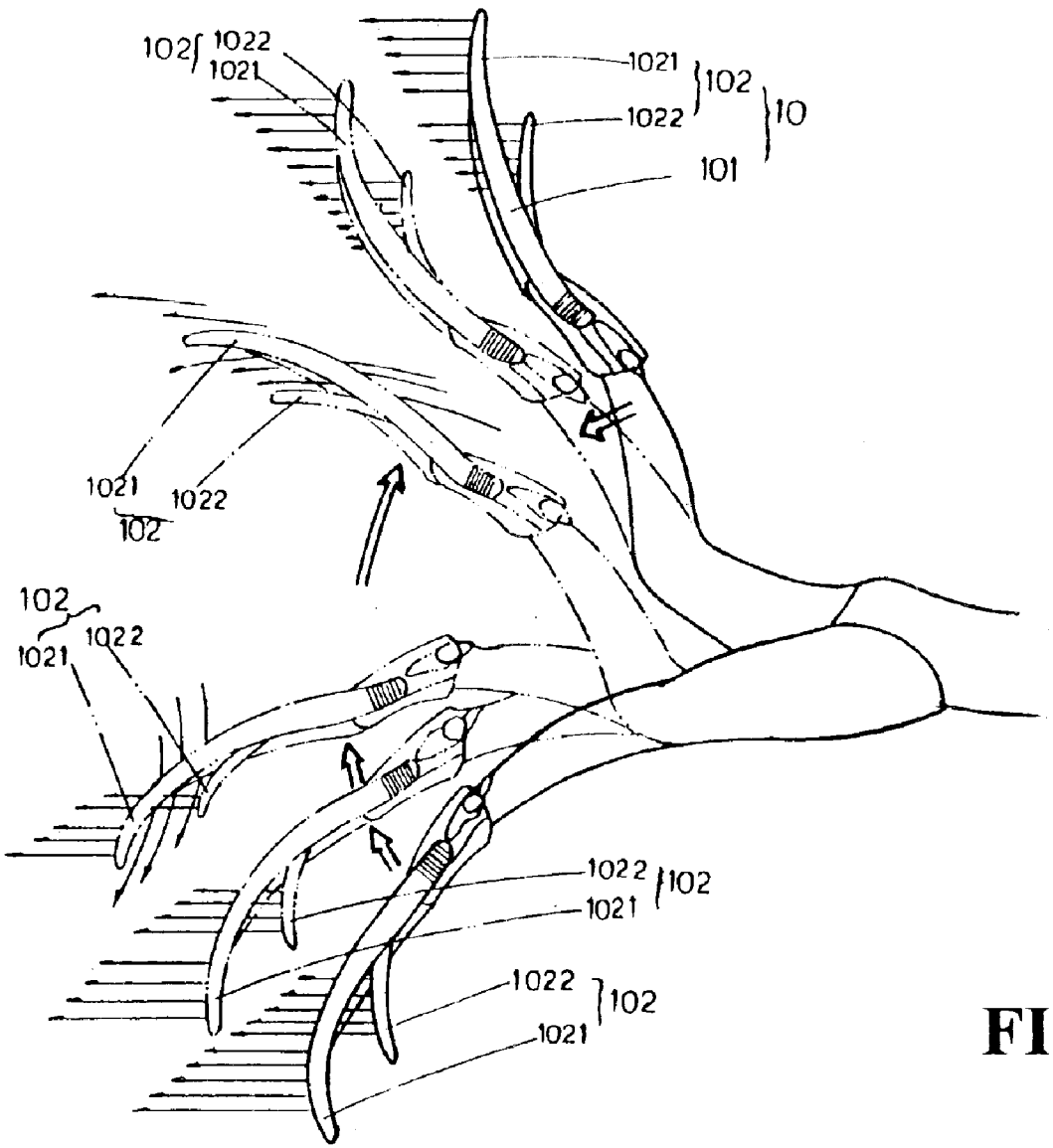
FIG. 10 is an illustrative diagram of FIG. 9 at another viewing angle.
Figure 11:
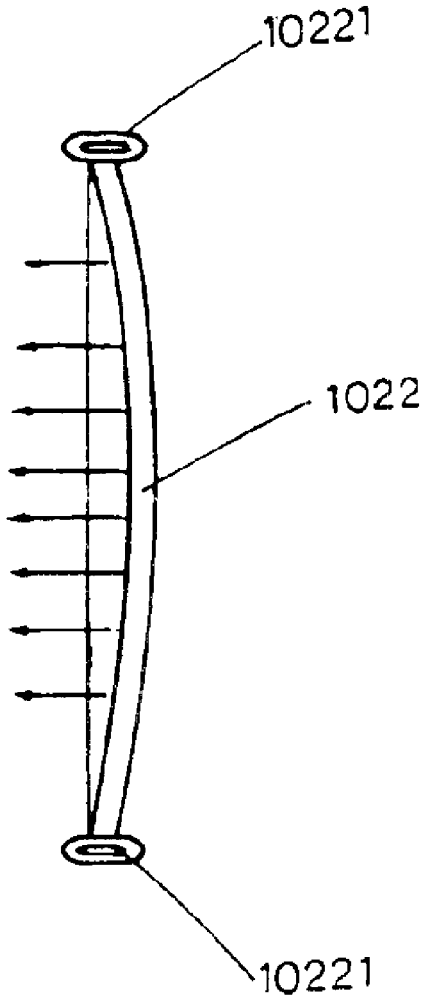
FIG. 11 is an illustrative diagram of the aquatic kicking of the second web surface in the shape of a dipper.

Please refer to FIGS. 9 and 10 for the present invention comprising the foregoing components. When a diver articulates both legs rearward and downward for aquatic kicking by posterior extension, due to the flexing potential of the second web surface 1022, it is automatically displaced in the direction opposite to movement of both legs by the force of water resistance and then reverts to a nearly perpendicular disposition as the rigidity of the first web surface 1021 follows in a coordinated action during the kicking sequence and, said first and second web surfaces 1021 and 1022 are alternately articulated into the nearly perpendicular disposition to respectively provide a larger surface area of force application and thereby generate a larger magnitude of thrust. More particularly, a each of the pair of second longitudinal flukes 10221 with its front section thinner than its rear section is disposed on a respective one of the opposing longitudinal sides of the second web surface 1022, such that both sides have better support than the center. When a diver kicks the water, a concave curve is formed automatically at the center by the force of water resistance (please refer to FIG. 11). Further, the concave curve serves like a dipper that contains water, and the water is kicked towards the center and pushed rearward instead of flowing sideway. Obviously, the push force so produced is increased, and the aquatic kicking efficiency is enhanced. Of course, if such aquatic kicking efficiency can further be improved, the diver can lower the frequency of the aquatic kicks, and thus giving a better power-conserving effect.

Further, when the diver articulates both legs frontward and upward for aquatic kicking by anterior extension, the second web surface 1022 swings in the direction opposite to the legs due to the force of water resistance will automatically produce a guiding opening G for the water to pass through (please refer to FIG. 9). It surely has the effect of lowering the resistance of the water flow, and also can directly use its own flexibility as the force for the motion when the diver articulates both legs frontward and upward for aquatic kicking by anterior extension, which is similar to the aforementioned flutter kicking by both legs, and automatically kicks the water by the first web surface 1021 substantially in the vertical direction (please see FIG. 10). Therefore, when the diver bends each leg to prepare for the aquatic kicking, it will not offset the push force produced by the posterior extension, but can produce a substantial push force, so that the diver can maximize the aquatic kicking efficiency. Particularly, the design of the second longitudinal fluke 10221 also will form a concave curve similar to the shape of a dipper at the center during the swinging of the web, and the water passing through the guiding opening G will be guided rearward directly instead of flowing sideway. Furthermore, the water fluttered vertically will be centralized at the center and directly pushed rearward instead of flowing sideway in order to maximize the aquatic kicking efficiency.

As mentioned above, the tapered design of the second longitudinal fluke 10221 facilitates the swinging movement of the plastic second web surface 1022, and gives a motion similar to the swinging movement of a fish tail. Such arrangement gives better flexibility, agility, and naturality.

The second longitudinal fluke 10221 on each side of the second web surface 1022 has the rear end thereof coupled to a respective first longitudinal fluke 101 on a corresponding side of the longitudinal web section 102 by a plurality of transversal adjusting flukes 10222. Each of such transversal adjusting flukes 10222 can be cut by a cutting device such as a razor, (refer to FIGS. 5 and 6) to fit divers of different ages or physical strengths; since divers of different ages or sexes may have different physical strengths. The user can directly cut the transversal adjusting flukes 10222 according to individual physical capacity, or change the length of the swinging of the second web surface 1022 by cutting the transversal adjusting flukes. The reaction due to the force of the water resistance on the second web surface will be changed accordingly, so that the user can save energy and maximize the speed of aquatic kicking. In other words, the more the transversal adjusting flukes are cut, the longer are the lengths of the second and third ditches $A_2$, $A_3$, and the longer is the length of the swinging of the second web surface 1022. In addition, the flexibility of the plastic material of the web will weaken the swinging. Therefore, it has a substantial effect on conserving strength for a diver with weaker kicking power. On the contrary, if less transversal adjusting flukes 10222 are cut or none is cut, the length of the swinging of the second web surface 1022 and the flexibility of the plastic web will have a slight or no change to the original design for the direct use by divers with better physical strengths, and provides the most power conserving and best aquatic kicking efficiency for the diving speed.

Of course, the more the transversal adjusting flukes 10222 are cut, the longer and softer the second web surface 1022 will be. Such changes will slightly slow down the diving speed produced by the aquatic kicking motions, however, it is exactly the main purpose of setting such transversal adjusting flukes 10222 for this invention, because speed is not the only diver's requirement. Safety, entertainment, and even the durability by conserving strengths to complete a mission are the major considerations of a diver. The disposition of transversal adjusting flukes 10222 and its being cut to fit a diver's aquatic kicking can provide the most appropriate operation requirement to the diver, and surely can attain the purpose for a more diversified and broader application effect.

Further, since the first web surface 1021 fixed at the front section of the longitudinal web section 102 has a conical transversal fluke 10211 disposed at its rear section (see FIGS. 7 and 8) with its front section thinner than its rear section, and the transversal fluke 10211 can directly produce a water flow being guided toward the thinner front end when a diver kicks or prepares to kick the water; it is very obvious that the kicked water flow can smoothly flow rearwardly without producing a backflow situation. Naturally, it provides better effect on the aquatic kicking efficiency.

In other words, the simple and concise improved diving fins of this invention not only improve the aquatic kicking efficiency, but also substantially enhance the safety of the diving, which surely benefits the divers.

What is claimed is:

1. An improved diving fin, comprising:

a first web surface extending between a pair of first longitudinal flukes;

a second web surface extending between a pair of tapered second longitudinal flukes;

each one of said pair of first longitudinal flukes and said pair of tapered second longitudinal flukes being connected at respective rear ends thereof;

a plurality of transversal adjusting flukes separately coupled between each one of said pair of first longitudinal flukes and a corresponding one of said pair of tapered second longitudinal flukes at said rear ends; and a conical transversal fluke having its front end thinner than its rear end, said conical transversal fluke being disposed at a rear end of said first web surface.

2. The improved fin of claim 1, wherein at least one of said transversal adjusting flukes between each of said first longitudinal flukes and said tapered second longitudinal flukes is cut by a cutting tool to change the length of web surface.

* * * * *